United States Patent [19]

Duyvesteyn

[11] 4,195,065

[45] Mar. 25, 1980

[54] LEACHING NICKELIFEROUS OXIDE ORES

[75] Inventor: Willem P. C. Duyvesteyn, Arvada, Colo.

[73] Assignee: Amax Inc., Greenwich, Conn.

[21] Appl. No.: 958,287

[22] Filed: Nov. 6, 1978

Related U.S. Application Data

[63] Continuation-in-part of Ser. No. 820,624, Aug. 1, 1977, abandoned.

[51] Int. Cl.[2] ..... C01G 53/10

[52] U.S. Cl. ..... 423/150

[58] Field of Search ..... 423/140, 145, 146, 150; 75/101 R, 115, 119

[56] References Cited

U.S. PATENT DOCUMENTS

| | | | |
|---|---|---|---|
| 3,436,177 | 2/1969 | Spedden | 423/145 |
| 3,773,891 | 11/1973 | O'Neill | 423/150 |
| 3,793,430 | 2/1974 | Weston | 423/150 |
| 4,044,096 | 8/1977 | Queneau et al. | 423/150 |
| 4,098,870 | 7/1978 | Fekete et al. | 423/150 |
| 4,128,617 | 12/1978 | DeGuire | 423/145 |

OTHER PUBLICATIONS

Cotterill et al., Editors, *Lead and Zinc,* vol., II, AIME, N. Y. 1970, pp. 425, 426.

*Primary Examiner*—Brian E. Hearn
*Attorney, Agent, or Firm*—Michael A. Ciomek

[57] ABSTRACT

In leaching a slurry of nickeliferous oxide ore containing less than about 35% iron with sulfuric acid under superatmospheric pressures at temperatures between about 230° C. and about 300° C. a water-soluble alkali metal or ammonium compound is added to the slurry after leaching is more than about 50% complete whereby the settling characteristics of the leached slurry during solids-liquids separation are improved.

13 Claims, No Drawings

LEACHING NICKELIFEROUS OXIDE ORES

RELATED APPLICATIONS

This application is a continuation-in-part of patent application Ser. No. 820,624 filed Aug. 1, 1977, which is now abandoned.

FIELD OF THE INVENTION

The present invention relates to leaching nickel from nickeliferous oxide ores and, more particularly, to the acid leaching of such ores.

BACKGROUND OF THE INVENTION

A number of processes for leaching nickel from nickeliferous oxide ores are known. One process is described in "The Winning of Nickel" by Boldt and Queneau, published by Longman's Canada Ltd., Toronto at pages 437 to 444. The process described by Boldt and Queneau is the process used at Moa Bay for leaching nickel from nickeliferous limonites (high iron, low magnesia oxide ores). Raw nickeliferous limonite is slurried with water and preheated to between 230° C. and about 260° C. The preheated slurry was then fed to the first of a series of autoclaves along with the requisite amount of sulfuric acid. The acidified slurry then flowed through the train of autoclaves by gravity. Total leaching time was between 1 and 2 hours. After lowering the slurry to atmospheric temperatures and pressures the resulting pregnant solution was separated from the residual solids in standard thickeners.

Another process for leaching nickeliferous oxide ores is taught in U.S. Pat. No. 3,793,430 to Weston. Weston discloses a process for leaching nickeliferous oxide ores in which the ore is slurried with an aqueous sulfuric acid solution to provide the solution with a predetermined ferric iron concentration which is effective in increasing nickel recoveries. Weston employs a conditioning reagent to improve nickel recoveries and to precipitate iron from solution. The conditioning reagents include water-soluble alkali metal compounds. Weston suggests that leaching can be conducted at temperatures up to 300° C. and that when leaching is conducted at temperatures in excess of 100° C. the conditioning reagent is preferably added when the leach slurry is let down to ambient pressures. An important consideration in direct acid leaching process, about which Weston is silent, is the efficiency of the solids-liquid separation operation after leaching.

Most processes for leaching nickeliferous oxide ores with sulfuric acid were applied to nickeliferous oxide ores having iron contents in excess of about 40% iron, i.e. limonitic nickeliferous oxide ores. In most nickeliferous oxide ores there is an inverse relationship between the iron content and the more acid soluble constituents, such as magnesia. The prior art processes were developed to treat nickeliferous oxide ores containing more than about 40% iron in order to minimize sulfuric acid consumption. These processes rely on the decreasing solubility of ferric ions with increasing leaching temperatures. Ferric ions dissolved at lower leaching temperature or at higher acid concentrations are hydrolyzed as the leaching temperature is increased or as sulfuric acid is consumed by the leaching reactions. If leaching is conducted at temperatures below about 250° C. ferric ions are hydrolyzed as a gelatinous precipitate which inhibits solids-liquid separation. A common technique to alleviate the problem is to conduct the leaching operation at temperatures in excess of about 260° C. or to heat the reacted slurry to such temperatures whereby the gelatinous precipitate is converted to a more readily filterable form.

When leaching garnieritic ores, i.e., ores having an iron content less than about 35%, the technique of leaching at temperatures above 260° C. or heating leached slurry to such temperatures becomes less effective as a means of enhancing the solids-liquids separations as the iron content of the ore decreases. This is because other reactions which produce other products that inhibit the solids-liquids separation become more and more significant and ultimately predominate. When treating garnieritic ores reactions involving silica and the precipitation of silica sols or even a gelatinous silica precipitate. The process in accordance with the present invention is directed to the treatment of nickeliferous oxide ores having a significant garnieritic fraction to increase the settling of solids during solids-liquids separation.

SUMMARY OF THE INVENTION

The present invention relates generally to a process for leaching nickel from nickeliferous oxide ores containing less than about 35% iron. The process comprises forming a slurry of the nickeliferous oxide ore with water, preheating the slurry to a leaching temperature between about 230° C. and 300° C., adding to the preheated slurry sulfuric acid in an amount between about 0.15 part and about 0.8 part for each part of dry ore whereby the nickel values are leached from the nickeliferous oxide, adding a water-soluble compound of at least one member selected from the group consisting of alkali metal compounds or ammonium compounds to the slurry during leaching but after the leaching reactions are at least one-half complete in small but effective amounts to minimize dissolution of silica, neutralizing the leach slurry and separating the leach liquor from the leached solids. Practice of the present invention enhances the liquid-solids separation operation.

DETAILED DESCRIPTION OF THE INVENTION

All nickeliferous oxide ores can be treated by the process in accordance with the present invention. However, the process of the present invention finds its greatest utility in treating nickeliferous silicate ores, i.e., ores having comparatively low iron contents and comparatively high magnesia contents, often referred to a garnierites. More specifically, ores containing less than about 35% iron, advantageously, less than about 30% iron and, most advantageously, less than about 25% iron, can be treated by the process in accordance with the present invention. Ore blends formed before, during or after leaching having the foregoing iron contents can be treated by the process in accordance with the present invention. Deep sea nodules can also be treated by the process in accordance with the present invention and are intended to fall within the term "nickeliferous oxide ores."

Raw ore from the mine is, if necessary, crushed or ground without drying to provide a feed material that will form stable slurries and will readily react with the leaching solution. If the ore must be ground, it is ground to a particle size such that about 100% passes through a 30 mesh screen (U.S. Screen Size). The finely divided ore is then formed into an aqueous slurry containing between about 25% solids and about 50% solids, and advantageously between about 35% solids and about 45% solids. Slurries containing solids within the foregoing ranges minimize materials handling problems while insuring efficient utilization of autoclave capacity.

The slurried ore is fed to a preheating vessel in which the slurry is preheated to a leaching temperature between about 230° C. and about 300° C. Preheating can be accomplished indirectly or by injecting live steam into the slurry. The preheated slurry is then fed to an autoclave where sulfuric acid in an amount between about 0.15 part and 0.8 part for each part of dry ore is added. Nickeliferous oxide ores are generally a blend of limonitic and silicate fractions, and higher iron contents up to 55% indicate increasing amounts of the limonitic fraction. Acid additions are keyed to the nature of the ore being treated. Sulfuric acid is added in amounts between about 0.15 part and about 0.3 parts for each part of dry ore and between about 0.45 part and about 0.8 part for each part of dry ore for limonitic and silicate ores, respectively, and for ores that are blends of limonites and silicates the acid additions are adjusted in accordance with the relative proportions of limonites and silicates in the particular blend. For most oxide ores which are a blend of limonites and silicates, acid additions in amounts between about 0.1 part and about 0.4 part per part of dry ore are generally sufficient. The autoclave is maintained at a temperature between about 230° C. and about 300° C. to leach about at least 90% of nickel contained in the feed material. Advantageously, the process is conducted on a continuous basis by employing a train of autoclaves and feeding the preheated slurry to the first autoclave and transferring slurry from one autoclave to another by gravity or by employing a single autoclave having a series of baffles that permit continuous operation. Again, the requisite amount of acid is added to the autoclave to insure that at least about 90% of the nickel is extracted from the ore.

The sulfuric acid can be added to the preheated slurry either as a single addition or incrementally to the autoclave or autoclaves. When using incremental additions, between about 40% and about 70% of the total acid is initially added to the autoclave or the first autoclave in a train and the remainder of acid is then added in at least two equal stages or in substantially equal amounts to each of the autoclaves in the train.

When the leaching reactions are completed, the reacted slurry can be cooled to below its boiling point, let down to atmospheric pressure and then neutralized with fresh garnieritic ore or other suitable neutralizing reagent. The reacted slurry can also be neutralized with fresh garnieritic ore before being cooled to below its boiling point and atmospheric pressure in order to improve the kinetics of the neutralizing reactions at the elevated temperatures. Alternatively, the reacted slurry can be cooled to below its boiling point and neutralized with fresh garnieritic ore and the partially spent garnieritic ore from neutralization can, after liquid-solid separation, be recycled to one or more of the latter leaching stages. The neutralized slurry is then subjected to conventional liquid-solid separation techniques to provide a pregnant solution containing nickel and any cobalt and a spent residue that is sent to waste.

An important feature of the present invention is the addition of a water-soluble alkali metal or ammonium compound to the slurry to improve liquids-solids separation. The water-soluble alkali metals or ammonium compound has its greatest effect on silicate ores and while there is less improvement in these properties when treating ores containing a significant limonitic fraction, the improvement is still significant. Because the alkali metal and ammonium cations react with solubilized iron and aluminum to form highly insoluble species of jarosites and alunites which consume the cations, it is advantageous to add the compounds when leaching is more than half complete so that a sufficient amount of the cations remain in solution to improve the settling rate of the leached solids.

The nature of the ore determines the amount of the compound added to the slurry. From an operational standpoint, it is rarely necessary to use amounts of the alkali metal or ammonium compound in excess of amounts equivalent to an anhydrous sodium sulfate addition of about 5%, based on the dry weight of the ore. All of the advantages can usually be achieved for most ores when the alkali metal or ammonium compound is added to the slurry in amounts equivalent to anhydrous sodium sulfate additions between about 0.5% and about 2.5%, based on the dry weight of the ore, and advantageously in amounts between about 1.5% and about 2.5%. Any water-soluble compound of at least one member selected from the group consisting of alkali metals and ammonium can be used for treating the slurry. Nonlimiting examples of such water-soluble compounds include sodium sulfate, sodium chloride, sodium nitrate, sodium bisulfate, sodium hydroxide, sodium carbonate, sodium bicarbonate, sodium phosphate, sodium silicate, ammonium sulfate, ammonium chloride, ammonium nitrate, ammonium bisulfate, ammonium hydroxide, ammonium phosphate, potassium sulfate, potassium chloride, potassium nitrate, potassium phosphate, potassium silicate and potassium bisulfate. Compounds of other alkali metals are equally effective, but because of their cost it is preferred to employ the more common alkali metal compounds. From the standpoint of cost and availability, sodium sulfate is the preferred compound.

Leaching temperatures between about 230° C. and 300° C. are employed to provide high nickel recoveries along with high throughput rates. At these high temperatures and with high free acid concentrations substantial amounts of silica can be dissolved and subsequently precipitated when the leach slurry is neutralized cooled. The precipitated silica interferes with the liquid-solids separation operation. It is believed, although the invention is not limited thereto, that the addition of water-soluble alkali metal or ammonium compounds provides alkali metal or ammonium ions which replace cations leached from the silicate crystal lattice thereby minimizing the amount of silica taken into solution as silicic acid which upon neutralization and cooling precipitates in such a form that it impedes solids-liquid separation.

In order to give those skilled in the art a better understanding of the present invention, the following illustrative examples are given:

EXAMPLE I

A garnieritic ore containing 3.1% nickel was pulped with water to provide a slurry containing 35% solids. The slurry was preheated to 270° C. and sulfuric acid in an amount of 0.69 part for each part of the dry ore was incrementally added to the preheated slurry as the slurry was conveyed by gravity through a series of three autoclaves which were maintained at 270° C. A solution of sodium sulfate in an amount equivalent to 78 pounds of anhydrous sodium sulfate per ton of ore was added to the slurry midway through the train of autoclaves. Upon flashing and subsequent liquid-solids separation in a counter-current decantation system, the first thickener provided an underflow residue containing 34% solids. Analysis showed that 94.5% of the nickel contained in the ore had been extracted.

A similar test was conducted for comparative purposes without a sodium sulfate addition. In this test, the underflow contained only 22% solids and the nickel extraction was only 92.5%. Thus, the sodium sulfate addition lowered the residual nickel in the leach residue by 27% and increased solids content in the underflow by 54.4%.

EXAMPLE II

A nickeliferous oxide ore containing equal fractions of garnierite and limonite and having an overall nickel content of 2.1% was treated in the same manner as described in Example I except that a lower acid addition of 0.46 part per part of dry ore was employed because of the higher iron content of the overall ore and the sodium sulfate addition was equivalent to an anhydrous sodium sulfate addition of 24 pounds per ton of dry ore. The underflow from the first thickener from the countercurrent decantation circuit contained 51% solids, when 0.42 pounds of a polyacrylamide based flocculant was used per ton of solids in the residue, and analyses show that 96.8% of the nickel had been extracted.

A comparative test without the sodium sulfate addition provided a nickel extraction of 94.2% and an underflow residue containing 41% solids with 1.23 pounds of flocculant. Thus, the sodium sulfate additions lowered the nickel content in the residue by 45%, increased the solids content of the underflow by 25% and reduced the flocculant consumption by 65%.

EXAMPLE III

A nickeliferous oxide ore having a nickel content of 1.8% was slurried with water to provide a slurry containing 45% solids. Sodium sulfate in an amount equivalent to 50 part of anhydrous sodium sulfate per ton of dry ore was added to the slurry.

The ore was preheated to 270° C. and then fed to a train of gravity fed autoclaves maintained at 270° C. Sulfuric acid was incrementally fed to the slurry as the slurry progressed from one autoclave to another in a total amount of 0.26 part for each part of ore.

Upon leaving the final autoclave the slurry was flashed and cooled to ambient temperatures. Liquid-solids separation produced an underflow residue containing 57% solids, and analyses showed that about 95.2% of the nickel contained in the ore has been extracted.

A comparative test without the sodium sulfate addition was run. The underflow from liquid-solids separation had a solids content of 47% and analyses showed that nickel extract-ions were only 94.1%.

EXAMPLE IV

Four high-temperature leach tests were carried out. In two tests the leach temperature was maintained at about 260° C. and in the other two the temperature was around 200° C. The leach feed consisted of a 1:1 mixture of a garnierite and laterite and analyzed 2.2% Ni, 4.4% Mg, 37.1% Fe and 4.5% Al. Sulfuric acid was added incrementally with a constant acid to leach feed ratio of 0.46. After 45 minutes, a garnierite residue assaying 2.8% Ni, 14.4% Mg, 8.9% Fe and 1.5% Al was injected into the autoclave. The weight of the residue amounted to 10% of the leach feed weight. In two test sodium sulfate, amounting to 2% of weight of the leach feed, was mixed in with the garnierite residue. The leach tests were continued for another fifteen minutes. After the pressure letdown, the leach residue was subjected to sedimentation in a certrifuge. It has been shown in the past that this centrifuging test resembles very well the ultimate compaction which can be obtained under pilot plant conditions. The results are presented in the following table:

| LEACH CONDITIONS | | | | | THICKENING RESPONSE | | | | |
|---|---|---|---|---|---|---|---|---|---|
| Test | Leach Temp | Acid/ Leach | Freed Acid In Leach | $Na_2SO_4$/ Leach | Initial | Final | METAL EXTRACTION % | | |
| No. | °C. | Feed | Discharge | Feed | % Solids | % Solids | Ni | Mg | Al |
| 1 | 260 | 0.46 | 52 gpl | 0.02 | 19.1 | 48.7 | 96.2 | 89 | 7 |
| 2 | 260 | 0.46 | 44 gpl | 0 | 18.6 | 42.7 | 91.8 | 88 | 27 |
| 3 | 200 | 0.46 | 48 gpl | 0.02 | 21.8 | 44.9 | 81.2 | 86 | 11 |
| 4 | 200 | 0.46 | 39 gpl | 0 | 19.0 | 44.8 | 73.6 | 82 | 39 |

The results of these tests show that as leaching temperatures increase the solids content of the leach residue after final liquid-solids separation decrease in the absence of the addition of an alkali metal or ammonium compound. The results show further that the addition of the alkali metal or ammonium compound is effective in improving the liquid-solid separation only at the higher leaching temperatures. At leaching temperatures of 260° C. the addition of sodium sulfate increased the solids content of the first liquid-solids separation operation by 14%, a highly significant improvement bearing in mind the costs and space requirements for thickeners and settlers.

Although the present invention has been described in conjunction with the preferred embodiments, it is to be understood that modifications and variations may be resorted to without departing from the spirit and scope of the invention, as those skilled in the art will readily understand. Such modifications and variations are considered to be within the purview and scope of the invention and the appended claims.

I claim:

1. In a process for recovering nickel from nickeliferous oxide ores containing less than about 35% iron in which the ore is slurried with water, the slurry is preheated to a leaching temperature between about 230° C. and about 300° C., sulfuric acid in an amount between about 0.15 part and about 0.8 part for each part of dry ore is added to the preheated slurry to leach the nickel values from the nickeliferous oxide ores, the leached slurry is neutralized and the neutralized slurry is subjected to a liquids-solids separation operation, the improvement which comprises: adding at least one water-soluble compound selected from the group consisting of alkali metal or ammonium compounds to the slurry when the leaching reactions are more than half complete in small but effective amounts to minimize dissolution of silica, whereby the settling rate of the neutralized slurry is improved.

2. The process as described in claim 1 wherein a high magnesia nickeliferous oxide ore is added to the slurry at the leaching temperature after the leaching reactions are complete to neutralize most of the free acid contained in the leach liquor and to recover a substantial portion of the nickel contained in the high magnesia containing ore.

3. The process as described in claim 1 wherein the leached slurry is cooled and let down to atmospheric pressure and neutralized with fresh high magnesia nickeliferous oxide ore and the residue from neutralization is fed to the leach slurry at the leaching temperature after the leaching reactions are completed.

4. The process as described in claim 1 wherein the amount of water-soluble compound added to the slurry is up to about 5%, based on the dry weight of the ore.

5. The process as described in claim 4 wherein the water-soluble compound is added in amounts between about 0.5% and about 2.5%, based on the dry weight of the ore.

6. The process as described in claim 5 wherein the water-soluble compound is added in amounts between about 1.5% and about 2.5%, based on the dry weight of the ore.

7. The process as described in claim 6 wherein the water-soluble compound is at least one member selected from a group consisting of sodium sulfate, sodium chloride, sodium nitrate, sodium bisulfate, sodium hydroxide, sodium carbonate, sodium bicarbonate, sodium phosphate, sodium silicate, ammonium sulfate, ammonium chloride, ammonium nitrate, ammonium bisulfate, ammonium hydroxide, ammonium phosphate, potassium sulfate, potassium chloride, potassium nitrate, potassium phosphate, potassium silicate and potassium bisulfate.

8. The process as described in claim 7 wherein the water-soluble compound is sodium sulfate.

9. In a process for recovering nickel from nickeliferous oxide ores containing about 37.1% iron in which the ore is slurried with water, the slurry is preheated to leaching temperature between about 230° C. and about 300° C., sulfuric acid in an amount between about 0.15 part and about 0.8 part for each part of dry ore is incrementally added to the preheated slurry to maintain the aluminum content of the slurry at a value of less than about 3 grams per liter to leach the nickel values from the nickeliferous oxide ores, the leached slurry is neutralized and the neutralized slurry is subjected to liquid-solids separation, the improvement which comprises: adding at least one water-soluble compound selected from the group consisting of alkali metal or ammonium compounds to the slurry when the leaching reactions are more than 50% complete in small but effective amounts to minimize dissolution of silica whereby the settling rates of the neutralized slurry is improved.

10. In a process for recovering nickel from nickeliferous oxide ores containing less than about 35% iron in which the ore is slurried with water, the slurry is preheated to leaching temperature between about 230° C. and about 300° C., sulfuric acid in an amount between about 0.15 part and about 0.8 part for each part of dry ore is added to the preheated slurry to leach the nickel values from the nickeliferous oxide ores, the leached slurry is neutralized and the neutralized slurry is subjected to a liquid-solid separation operation, the improvement which comprises: adding at least one water-soluble compound selected from the group consisting of alkali metal or ammonium compounds to the slurry when the leaching reactions are more than about 50% complete in small but effective amounts to minimized dissolution of silica whereby the settling rates of the neutralized slurry is improved.

11. The process as described in claims 9 or 10 wherein the amount of water-soluble compound added to the slurry is up to about 5%, based on the dry weight of the ore.

12. The process as described in claims 9 or 10 wherein the water-soluble compound is added in amounts between about 0.5% and about 2.5% based on the dry weight of the slurry.

13. The process as described in claims 9 or 10 wherein the water-soluble slurry compound is sodium sulfate.

* * * * *